US011624481B2

(12) United States Patent
Sams

(10) Patent No.: US 11,624,481 B2
(45) Date of Patent: Apr. 11, 2023

(54) ODORIZATION SYSTEM

(71) Applicant: Welker, Inc., Sugar Land, TX (US)

(72) Inventor: Stephen Russell Sams, Sherman, TX (US)

(73) Assignee: Welker, Inc., Sugar Land, TX (US)

( * ) Notice: Subject to any disclaimer, the term of this patent is extended or adjusted under 35 U.S.C. 154(b) by 260 days.

(21) Appl. No.: 17/063,904

(22) Filed: Oct. 6, 2020

(65) Prior Publication Data

US 2021/0108763 A1 Apr. 15, 2021

Related U.S. Application Data

(60) Provisional application No. 62/912,807, filed on Oct. 9, 2019.

(51) Int. Cl.
*F17D 3/12* (2006.01)

(52) U.S. Cl.
CPC ..... *F17D 3/12* (2013.01)

(58) Field of Classification Search
None
See application file for complete search history.

(56) References Cited

U.S. PATENT DOCUMENTS

| | | | | |
|---|---|---|---|---|
| 4,007,755 | A | 2/1977 | Lerner | |
| 4,504,281 | A * | 3/1985 | Williams, Jr. | C10L 3/006 137/806 |
| 6,142,162 | A | 11/2000 | Arnold | |
| 8,475,550 | B2 | 7/2013 | Zeck | |
| 2001/0014840 | A1 | 8/2001 | Marshall | |
| 2001/0047621 | A1 | 12/2001 | Arnold | |
| 2019/0203133 | A1* | 7/2019 | Welker | G05D 7/0641 |

FOREIGN PATENT DOCUMENTS

DE 69906472 T2 2/2004

OTHER PUBLICATIONS

Injection odorizing system DOSAODOR Catalog.

* cited by examiner

*Primary Examiner* — Jeffrey D Washville
(74) *Attorney, Agent, or Firm* — Husch Blackwell LLP

(57) ABSTRACT

An odorization system is provided that introduces foul-smelling odorant into a natural gas pipeline in order to make gas leaks more easily detectable. The system improves upon prior art odorization systems by using a pumpless mechanism driven by differential pressures. The elimination of pumps from the system reduces the likelihood of system failure and further reduces the likelihood that odorant leaks to atmosphere.

13 Claims, 2 Drawing Sheets

ODORIZATION SYSTEM

CROSS-REFERENCE TO RELATED APPLICATIONS

This Application claims priority to U.S. Provisional Patent Application Ser. No. 62/912,807, filed on Oct. 9, 2019, entitled "ODORIZATION SYSTEM" currently, the entire disclosure of which is incorporated herein by reference.

FIELD OF THE INVENTION

The present invention relates generally to introducing odorant into a natural gas pipeline in order to make leaks foul-smelling and thus more easily detected. More particularly, the present invention relates to a pumpless, pressure-driven system for injecting odorant into a natural gas supply.

BACKGROUND OF THE INVENTION

Natural gas is a clear, odorless and tasteless gas as it comes from the ground. For safety purposes, odorant is commonly injected into natural gas before it is distributed to customers. There are many prior art odorant injection systems including U.S. Pat. No. 6,142,162 owned by the assignee of the present application, which is incorporated herein by reference. Other odorant injection systems are disclosed in U.S. Pat. Nos. 5,406,970 and 6,208,913.

Modern odorant injection systems are often controlled by a programmable logic controller (PLC), a personal computer (PC), a flow computer, or some combination thereof. These automatic odorant injection systems often have audit features to confirm and document the odorant injection process. Those skilled in the art know that unwanted odorant vapors are sometimes vented to atmosphere without any filtration and that liquid odorant is sometimes disposed of using improper techniques. There is a need for an improved system to inject odorant without pumps that have seals that need replacement and to minimize or prevent odorant tainted vapors from entering the environment.

SUMMARY OF THE INVENTION

The odorization system hereof uses gas pressure to inject odorant into a pipeline by using the pipeline pressure upstream of the injection point to push the odorant into the pipeline at a point with lower pressure. The system is pumpless, and it uses the concept of differential pressure to inject odorant into the pipeline.

BRIEF DESCRIPTION OF THE DRAWINGS

For a better understanding of the present invention, reference may be made to the following accompanying drawings.

DETAILED DESCRIPTION OF THE INVENTION

Figure 1:
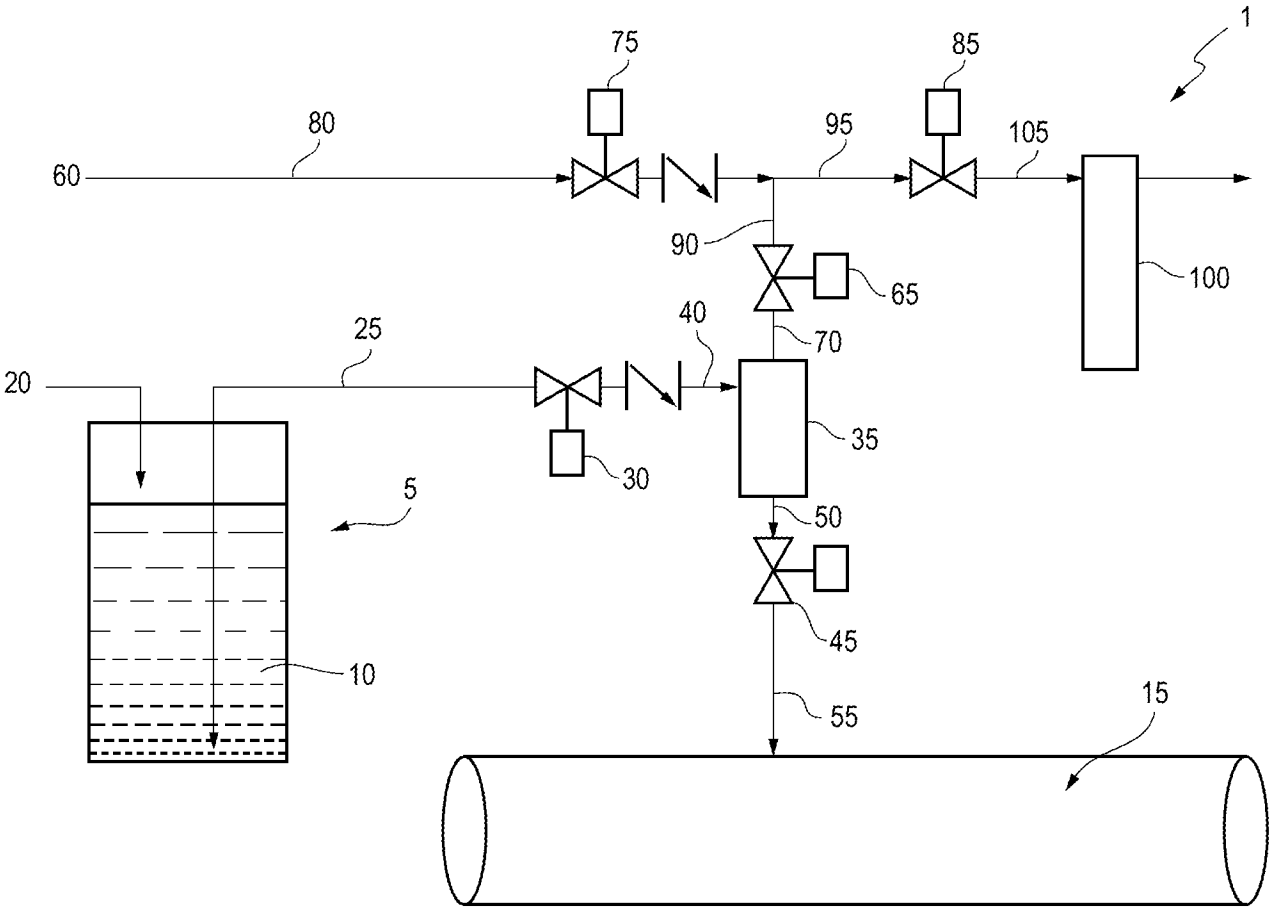
FIG. 1 is a schematic of an odorization system constructed according to the teachings hereof.

FIG. 1 illustrates an odorization system 1 that introduces odorant into a natural gas pipeline without the use of pumps. The odorization system 1 includes a pressurized tank 5 that contains odorant 10 that is eventually introduced to a pipeline 15. A blanket gas 20 applies pressure to the supply tank 5 such that odorant 10 enters a first odorant line 25 and flows up to an odorant solenoid valve 30. The odorant solenoid valve 30 is preferably in communication with a manifold 35 via a second odorant line 40.

The manifold 35 is preferably in communication with the pipeline 15 via an injection solenoid 45. The injection solenoid 45 may be in fluid communication with the manifold 35 via a third odorant line 50, and the injection solenoid 45 is in fluid communication with the pipeline 15 via a fourth odorant line 55. In addition to being in communication with the pipeline 15, the manifold 35 may be in communication with a high pressure gas source 60. The manifold 35 is preferably in communication with the high pressure gas source 60 by an isolation solenoid 65 that is in fluid communication with the manifold 35 directly by a first injection line 70.

Gas from the high pressure gas source 60 is directed toward a power gas solenoid 75 by way of a second injection line 80. The power gas solenoid 75 may be connected to each of the isolation solenoid 65 and a vent solenoid 85. The power gas solenoid 75 is in communication with the isolation solenoid 65 by a third injection line 90 and in communication with the vent solenoid 85 by way of a first vent line 95. The vent solenoid 85 is further in communication with a filter 100 that vents to atmosphere by a second vent line 105.

To initiate the introduction of the odorant 10 into the pipeline 15, the odorant solenoid 30 may first be opened. The odorant solenoid 30 and the other solenoids 45, 65, 75, 85 of the odorization system 1 may be controlled by timers or a programmable logic controller ("PLC," not illustrated). The pressure that is provided by the blanket gas 20 forces the odorant 10 to travel through the first odorant line 25 and the odorant solenoid 30 toward the manifold 35 by way of the second odorant line 40. With the isolation solenoid 65 closed, the odorant 10 enters the manifold 35. Because the injection solenoid 45 is also closed, the odorant 10 begins to accumulate within the manifold 35. The tank 5 may have pressure sufficient to deliver the odorant 10 to the manifold 35. In one embodiment, such pressure may be close to 30 PSI.

In one embodiment, rather than liquid odorant 10 being provided to the manifold 35, vapor from the odorant 10 may be provided to the manifold 35. This is an optional feature that may not be present in all embodiments of the odorization system 1.

When the manifold 35 has received the desired/programmed amount of the odorant 10, the odorant solenoid 30 may close. At this time, the odorant 10 is substantially isolated within the manifold 35 at the pressure of the tank 5, which as described above is 30 PSI in the current embodiment. It should be noted, however, that alternative pressures may be provided within the tank 5 and thus the manifold 35 when the odorant 10 is isolated therein.

In a next step, each of the power gas solenoid 75, isolation solenoid 65, and injection solenoid 45 may be opened. With the introduction of high pressure gas via the gas source 60 (which may be initiated by the PLC), injection gas is directed to the manifold 35. The high pressure gas that is introduced to the manifold 35 may enter the manifold 35 via the second injection line 80, the power gas solenoid 75, the third injection line 90, the isolation solenoid valve 65, and the first injection line 70. In some embodiments, the isolation solenoid valve 65 may be excluded from the odorization system 1.

With the introduction of the high pressure gas from the gas source 60 to the manifold 35, the odorant 10 that is within the manifold 35 is ejected from the manifold 35 toward the injection solenoid 45. The odorant is so directed due to the high pressure gas that is provided by way of the high pressure gas source 60. In one non-limiting exemplary embodiment, the gas may be provided 20 PSI greater than the pressure within the pipeline 15. Such high pressure gas not only forces the odorant 10 into the pipeline 15 via the solenoid 45 and the odorant line 55, but it also helps vaporize the odorant 10 prior to its introduction into the pipeline 15. In alternative embodiments, the injection solenoid 45 may be provided with a check valve, or it may be replaced with a check valve.

Next, the power gas solenoid 75 and the injection solenoid 45 may be closed when the odorant 10 has been fully or adequately injected into the pipeline 15. At this time, the isolation solenoid 65 is preferably open, and the manifold 35 is filled with the injection gas that was introduced from the high pressure gas source 60.

The vent solenoid 85 may now be opened while the isolation solenoid 65 is still open. The high pressure gas that was contained within the manifold 35 may now be vented through the filter 100 via the vent line 95, the vent solenoid 85, and the second vent line 105. Gas that is passed through the filter 100 may vent to atmosphere. Preferably, the filter 100 may help to get rid of any residual smell of the odorant 10 that remains in the high pressure gas. Once the manifold 35 is empty of the high pressure gas, the manifold 35 may return to atmospheric pressure.

Next, all solenoids 30, 75, 85, 65, and 45 may be closed. With the manifold 35 at its atmospheric pressure, the odorization system 1 is ready to repeat the aforementioned cycle as necessary.

Figure 2:
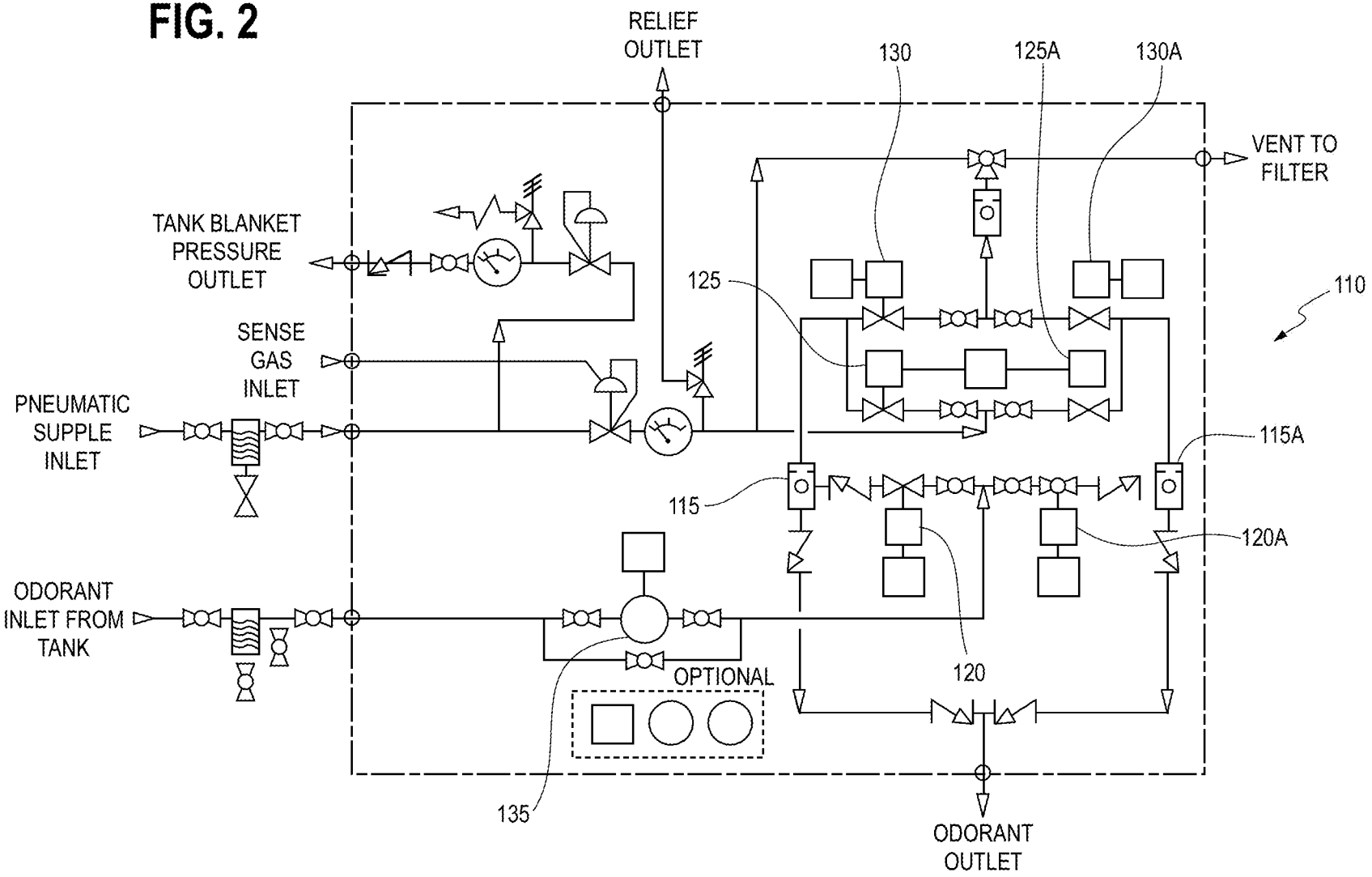
FIG. 2 is a schematic of an alternative embodiment of the odorization system of FIG. 1.

Turning to FIG. 2, an alternative odorization system 110 is illustrated. The odorization system 110 operates in a manner substantially similar to the odorization system 1. However, it includes a duplicative system that may operate to perform substantially the same functions as the various solenoids in the odorization system 1 in the event that it fails. The odorization system 110 may include a manifold 115, odorant solenoid 120, power gas solenoid 125, and a vent solenoid 130. It should be noted that in the odorization system 110, no isolation solenoid is present. In alternative embodiments, the odorization system 110 may include an isolation solenoid such as the solenoid 65 of the odorization system 1.

The manifold 115 and the solenoids 120, 125, 130 may act in a manner substantially similar to that as described for the odorization system 1. However, in the event that the solenoids 120, 125, 130 fail, solenoids 120A, 125A, and 130A, along with an alternative manifold 115A may be provided. It should be noted that the odorization system 110 may include a flow meter 135 that may dictate when to stop introducing odorant into the system 110.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles, and scope of the present invention.

Many changes, modifications, variations, and other uses and applications of the present invention will, however, become apparent to those skilled in the art after considering the specification and the accompanying drawings. All such changes, modifications, variations, and other uses and applications which do not depart from the spirit and scope of the invention are deemed to be covered by the invention, which is limited only by the claims which follow.

The invention claimed is:

1. An odorization system for introducing odorant into a natural gas pipeline, the odorization system comprising:

a tank for storing odorant;

a manifold in communication with the tank and the natural gas pipeline;

wherein a blanket gas applied to the tank forces odorant into the manifold;

wherein one or more solenoid valves control the flow of odorant to at least one of the manifold and the natural gas pipeline; and wherein one of the one or more valves is a vent solenoid located between the manifold and a vent to atmosphere.

2. The odorization system of claim 1, wherein one of the one or more solenoid valves is an odorant solenoid valve located between the tank and the manifold.

3. The odorization system of claim 1, wherein one of the one or more valves is at least one of an injection solenoid valve and a check valve located between the manifold and the pipeline.

4. The odorization system of claim 1, wherein one of the one or more valves is a power gas solenoid valve located between a location where the blanket gas is introduced to the odorization system and the manifold.

5. The odorization system of claim 1, wherein the one or more valves are controlled by a system controlling device.

6. The odorization system of claim 1, wherein a second odorization system is provided that introduces odorant into the natural gas pipeline.

7. The odorization system of claim 1, wherein the odorization system includes a flowmeter for determining when sufficient odorant has been injected into the system.

8. The odorization system of claim 1, wherein the blanket gas is applied at a pressure at least 20 PSI greater than the pressure within the natural gas pipeline.

9. An odorization system for introducing odorant into a natural gas pipeline, the odorization system comprising:

a tank for storing odorant a manifold in communication with the tank and the natural gas pipeline;

wherein a blanket gas applied to the tank forces odorant into the manifold;

wherein one or more solenoid valves control the flow of odorant to at least one of the manifold and the natural gas pipeline; and wherein residual gas in the manifold is vented to atmosphere after the blanket gas has been applied.

10. A method of introducing an odorant to a natural gas pipeline, the method comprising the steps of:

opening an odorant solenoid;

applying pressure via addition of a blanket gas to force odorant contained in a tank through the odorant solenoid into a manifold;

closing the odorant solenoid when the manifold has received a desired or pre-determined amount of the odorant so that the odorant is substantially isolated within the manifold at the pressure of the tank;

opening a power gas solenoid to introduce high pressure gas to the manifold via the power gas solenoid thus forcing the odorant out of the manifold;

opening an injection solenoid in communication with the manifold and the natural gas pipeline to allow odorant to force the odorant into the natural gas pipeline via the injection solenoid;

opening a vent solenoid in communication with the manifold and atmosphere and venting the high pressure gas contained within the manifold through the vent solenoid into the atmosphere.

11. The method of claim 10, further comprising the step of closing the power gas solenoid to stop introducing high pressure gas into the manifold.

12. The method of claim 10, further comprising the step of filtering gas that is passed through the vent solenoid.

13. The method of claim 10, further comprising the step of closing the vent solenoid.

* * * * *